United States Patent [19]

Hurst et al.

[11] Patent Number: 4,739,640

[45] Date of Patent: Apr. 26, 1988

[54] APPARATUS FOR COOLING AND/OR DRYING OR CLEANING ELONGATE MATERIAL

[75] Inventors: Michael J. Hurst, Southampton, Great Britain; Ronald A. Deane, Romsey, England

[73] Assignee: Hi-Draw Engineering Limited, Romsey, England

[21] Appl. No.: 750,759

[22] Filed: Jun. 28, 1985

Related U.S. Application Data

[63] Continuation-in-part of Ser. No. 493,906, May 12, 1983, abandoned.

[30] Foreign Application Priority Data

May 18, 1982 [GB] United Kingdom ..... 8214381

[51] Int. Cl.[4] ..... B21C 9/00

[52] U.S. Cl. ..... 72/38; 72/39; 72/286

[58] Field of Search ..... 15/306 A, 409; 72/38, 72/39, 45, 274, 278, 286; 134/64 R, 122 R, 122 P

[56] References Cited

U.S. PATENT DOCUMENTS

| | | | |
|---|---|---|---|
| 3,605,466 | 9/1971 | Kilcoin | 72/43 |
| 4,080,818 | 3/1978 | Gre | 72/278 |

FOREIGN PATENT DOCUMENTS

| | | | |
|---|---|---|---|
| 128482 | 11/1977 | German Democratic Rep. | |
| 55-24791 | 2/1980 | Japan | 72/45 |
| 1428889 | 3/1976 | United Kingdom | |

*Primary Examiner*—E. Michael Combs

*Attorney, Agent, or Firm*—Lilling & Greenspan

[57] ABSTRACT

Apparatus for use in cooling and/or drying or cleaning elongate material, such as drawn wire, tube or strip material, the apparatus comprising a chamber, which may be formed at least in part by a flexible tube, having an inlet and an outlet through which the material enters and leaves the chamber, and the chamber is connected via an outlet passage to a device which creates a sub-atmospheric pressure within the chamber. The sub-atmospheric pressure lowers the evaporation temperature of the cooling liquid which is on the surface of the material which evaporates and cools the material and the sub-atmospheric pressure causes air to flow into the chamber around the material in the region of the outlet and this airflow is at high velocity and wipes the material. The apparatus is preferably located on the end of a structure in which a drawing die is housed.

9 Claims, 7 Drawing Sheets

APPARATUS FOR COOLING AND/OR DRYING OR CLEANING ELONGATE MATERIAL

CROSS REFERENCE TO RELATED APPLICATION

This application is a continuation-in-part of U.S. Ser. No. 493,906, Filed May 12, 1983, abandoned.

BACKGROUND OF THE INVENTION

1. Field of the Invention

This invention relates to apparatus for use in cooling and/or drying or cleaning elongate material, particularly, but not exclusively, material such as a wire, tube or strip which has passed through a drawing die or forming rolls.

2. Description of the Prior Art

In the drawing of wire, tube or strip material, it is essential to cool the drawn elongate material to prevent it reaching temperatures which can effect its structure and it is also desirable to cool the die through which the material is drawn. There are many other instances where it is essential to cool a heated elongate material and the present invention is therefore not limited to drawing processes.

Elongate materials are sometimes cooled by the use of a cooling liquid and after cooling the wire it is usually necessary to dry the material. It is known to subject the wet material to a blast of compressed air in order to dry the material.

In applicants' application Ser. No. 493,906, there has been disclosed a drawing box in which a cooling liquid, such as water, is provided to cool the die and the material as it leaves the die, the material after passing through the water being passed through a chamber in which the pressure is at a sub-atmospheric pressure so that the cooling liquid which is on the surface of the elongate material is evaporated and advantage is taken of the higher latent heat of evaporation at the sub-atmospheric pressure to further cool and dry the elongate material.

Applicants have found that increased cooling of the elongate material can be achieved if the material on leaving the die is immediately passed through a partial vacuum before passing through the cooling liquid.

In the East German Pat. No. 128,482, there is described a method and apparatus for drying and cooling wire following a drawing process. However, the heated wire, emerging from the die is immediately introduced into a cooling liquid after which it is directed into a chamber of sub-atmospheric pressure for drying the material by evaporative cooling.

SUMMARY OF THE INVENTION

According to the present invention there is provided apparatus for use in cooling elongate material which has passed through a drawing die, comprising a structure defining a chamber, means for mounting a drawing die within the chamber, means for supplying a liquid coolant to the chamber, means for providing a reservoir of said liquid in which the drawing die is submerged, means within the structure for defining a second chamber located at the outlet side of the die and through which the drawn material passes before entering the reservoir, said structure having an inlet leading to the inlet side of the die and an outlet through which the drawn material passes after passing through the reservoir of liquid, and downstream of said outlet a third chamber through which the material passes, said second and third chambers each being connected to means for creating a sub-atmospheric pressure within the second and third chambers.

By providing the second chamber which is at a sub-atmospheric pressure cooling liquid is drawn from the reservoir through the outlet end of the second chamber and flows onto the surface of the drawn material and is evaporated within the second chamber.

The apparatus of the present invention can be used with a cooling liquid unit as an in line cooling device or it can form part of a cooling apparatus having means for subjecting the material to a cooling liquid applied upstream of the chamber. It can also form part of a drawing device. The appratus can also be used for drying and/or cleaning an elongate material.

BRIEF DESCRIPTION OF THE DRAWINGS

Some embodiments of the invention will now be described, by way of examples, with reference to the accompanying drawings, in which.

DESCRIPTION OF THE PREFERRED EMBODIMENTS

Figure 3:
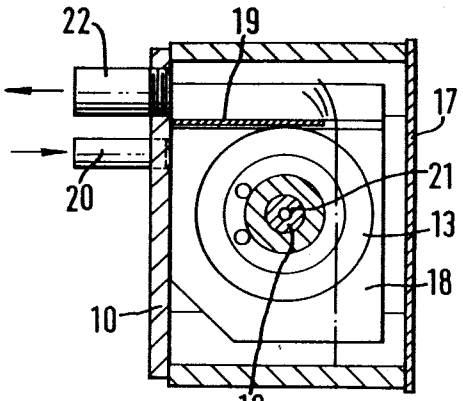
FIG. 3 is a transverse cross-section taken along the line 3—3 indicated on FIG. 2.
Figure 2:
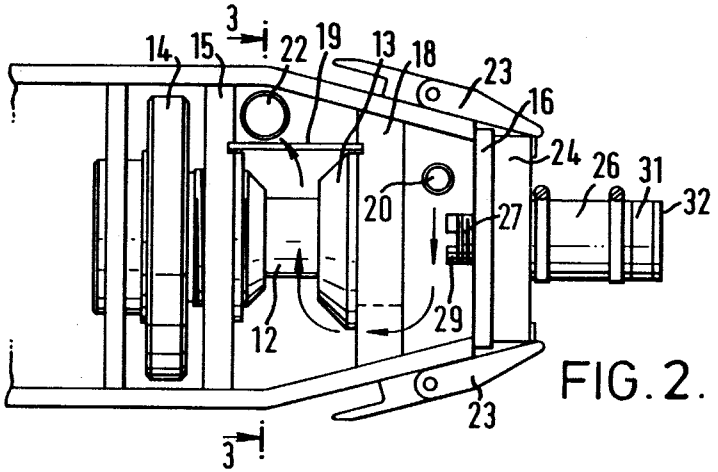
FIG. 2 is a plan view of the apparatus shown in FIG. 1.
Figure 1:
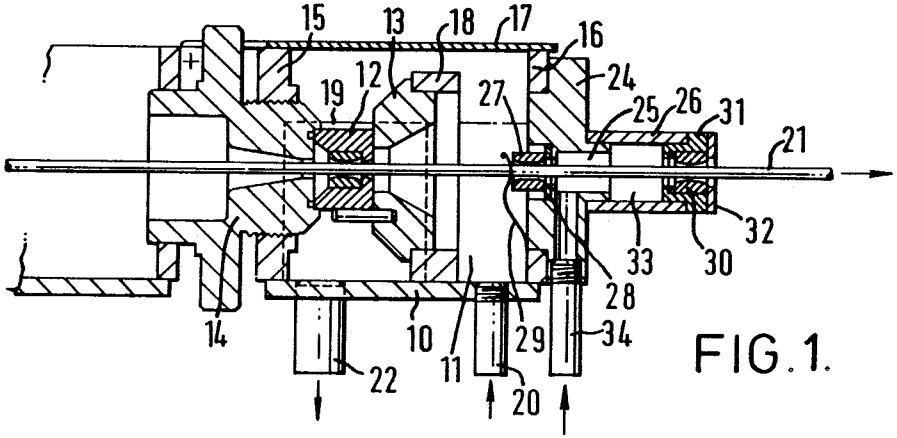
FIG. 1 is a longitudinal cross-section of a wire drawing device provided with apparatus according to the present invention.

The wire drawing device shown in FIGS. 1 to 3 comprises a structure 10 defining a chamber 11 in which is located a drawing die 12 which is clamped against the face of a die support 13 by a clamping nut 14 which exends through an end wall 15 forming part of the structure 10. The structure 10 has an end wall 16 and the chamber 11 can be closed by a loose cover 17 if desired. Located within the chamber 11 and extending between the end wall 15 and an intermediate wall 18 in which the die support 13 is mounted is a vertical plate 19 which is received in grooves provided in the walls 15 and 18 and which forms a weir. The structure 10 is provided with an inlet connection 20 through which a cooling liquid can flow into the chamber 11, the level of the liquid in the chamber 11 being determined by the weir plate 19 and is such as to submerge the drawing die 12 and the drawn wire 21. The cooling liquid after flowing over the weir plate 19 is drained through a drain conduit 22.

Mounted on the end wall 16 and held in position by clips 23 is an end cap 24 having an axial bore 25 and secured to the end cap 24 is a tube 26 which may be flexible if desired. The bore 25 is closed at one end by a wire guide 27 which seats against a flexible seal 28 and a flexible retainer 29 holds the guide 27 in position but allows the guide 27 to move so as to align itself on the wire axis. The end of the tube 26 is closed by a wire guide 30 provided in a mounting 31 and is retained in position by an end ring 32.

The bore 25 and tube 26 form a chamber 33 to which is connected an outlet conduit 34. The conduit 34 is connected to a vacuum source so as to produce a sub-atmospheric pressure in the chamber 33.

The apparatus shown in FIGS. 1 to 3 operates as follows:

The wire 21 is drawn through the die 12 in the direction indicated by the arrow in FIG. 1. A liquid coolant, such as water, flows into the chamber 11 through the inlet 20 and flows around the wall 18 and around the drawing die 12 to the weir plate 19. The liquid coolant flows over the top of the weir plate 19 and then flows through the drain conduit. The level of the liquid coolant within the chamber 11 is sufficient to submerge the drawing die 12 and the portion of the drawn wire 21 which extends through the chamber 11. Therefore, the drawing die 12 is cooled by the cooling liquid and immediately the wire 21 leaves the drawing die 12 it is immediately and directly rapidly cooled by the cooling liquid in the chamber 11.

Some of the cooling liquid will pass through the bore of the wire guide 27 with the wire 21 and the wire 21 thereby enters the chamber 33 in a wet condition. Because the pressure within the chamber 33 is below atmospheric pressure the vaporization temperature of the cooling liquid is lowered and the liquid on the wire is evaporated which further cools and dries the wire 21. Advantage is also taken of the higher latent heat of vaporization at the sub-atmospheric pressure. The sub-atmospheric pressure within the chamber 33 will cause air to flow into the chamber 33 through the guide 30 at high velocity which will wipe the wire 21 and sweeps any excess cooling fluid back into the chamber 33.

The guide 27 has a diameter which will give a controlled flow of water from a chamber 11 into chamber 33.

The air and water in chamber 33 is evacuated from the chamber 33 by the conduit 34.

The end cap 24 may be arranged to slide transversely to allow further alignment on the wire path. If the tube 26 is flexible further alignment is possible at the guide 30. In order to enable the wire 21 to be correctly set on the winding drum the path taken by the wire 21 from the outlet of the die 12 may have to be displaced from the axis of the die 12 and the adjustability of the guides 27, 30 allows this to be effected. By having quick-release clips 23 to secure the end cap 24 to the end wall 16, the whole of the low pressure assembly can be made readily detachable to facilitate the threading of the wire 21 through the apparatus. A short length lead or point can be made on the wire 21 which can then be drawn through the die 12 for a short distance before the low pressure assembly is passed over the wire 21 and clipped in position. Alternatively, the low pressure assembly may be made to divide along a central longitudinal plane which is on the center line to facilitate the threading of the wire 21.

Figure 4:
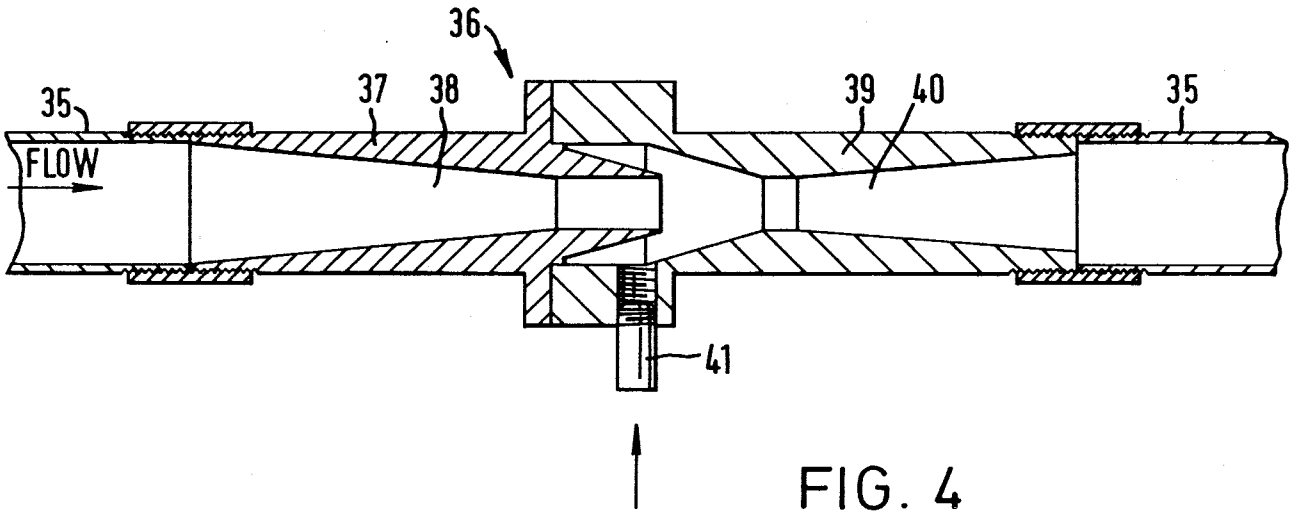
FIG. 4 is a longitudinal section through a venturi device for producing the below atmospheric pressure.

A suitable apparatus for creating the sub-atmospheric pressure within the chamber 33 is shown in FIG. 4 a comprises a conduit 35 provided with a venturi device 36 which consists of a portion 37 having a convergent passage 38 and a portion 39 having a convergent/divergent passage 40. Fluid is pumped through the conduit 35 in the direction indicated by the arrow and its kinetic energy is increased in the convergent passage 38 and a low pressure area at the convergent part of the convergent/divergent passage 40 is connected via a conduit 41 to the conduit 34 of the low pressure assembly of the apparatus shown in FIGS. 1 to 3. The fluid returns to approximately atmospheric pressure at the outlet of the divergent part of the convergent/divergent passage 40. The convergent passage 33 and the convergent/divergent passage 40 can be of any desired cross-sectional shape, e.g. round or rectangular.

It will be appreciated that any other suitable type of vacuum producing device could be used.

Figure 5:
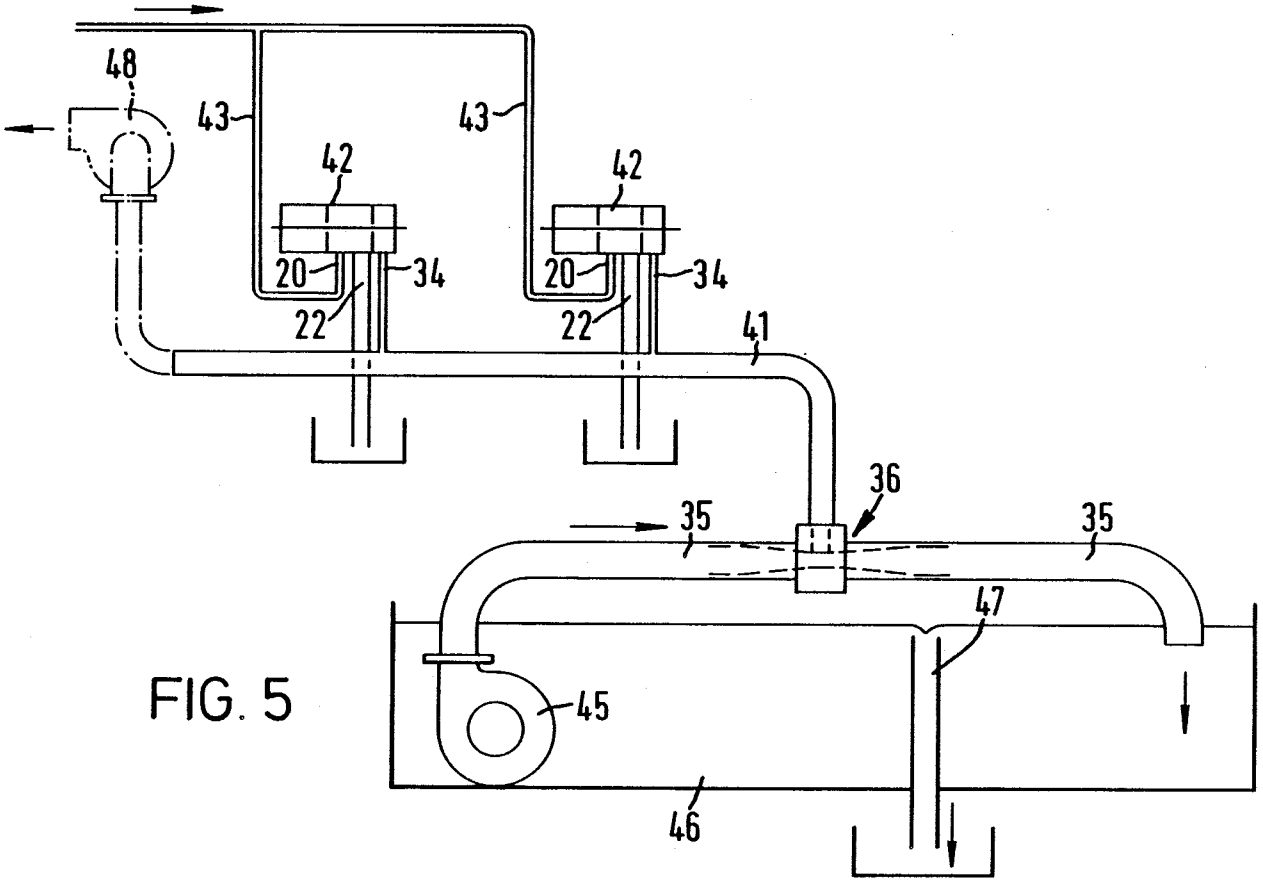
FIG. 5 is a diagrammatic illustration of a wire drawing system provided with apparatus according to the present invention.

FIG. 5 illustrates a multi-die wire drawing apparatus, each wire drawing device 42 being similar to that shown in FIGS. 1 to 3 and the venturi device 36 being as shown in FIG. 4. The inlet connection 20 of each wire drawing device 42 receives liquid coolant via conduits 43 and the drain conduits 22 of the devices 42 are connected to drain. The conduits 34 of the devices 42 are connected to the low pressure conduit 41 leading from the venturi device 36 and the fluid which is pumped by a pump 45 through the conduit 35 is withdrawn from a reservoir 46 and returned to the reservoir 46. The reservoir 46 has an overflow drain 47. If desired a secondary air vacuum pump 48 can be fitted to the conduit 41.

Figure 6:
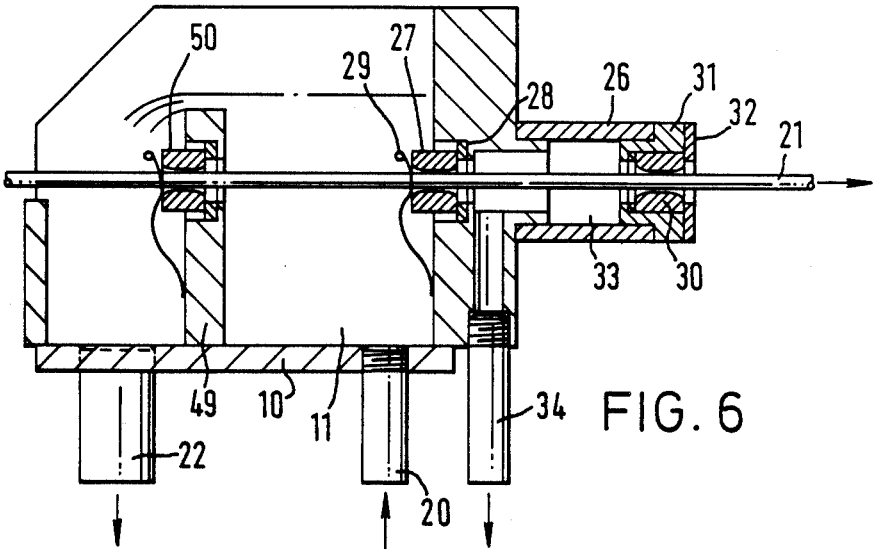
FIG. 6 is a longitudinal cross-section through a wire cooling device provided with apparatus according to the present invention.

FIG. 6 shows a wire cooling device which is very similar to the liquid cooled wire drawing device shown in FIGS. 1 to 3 but in which the drawing die 12 is not provided. In this wire cooling device the weir is formed by a wall 49 which separates the chamber 11 from the drain conduit 22 and the wall 49 is provided with a wire guide 50 similar to guide 27.

The device shown in FIG. 6 can be used to cool any wire which has been heated.

Figure 7:
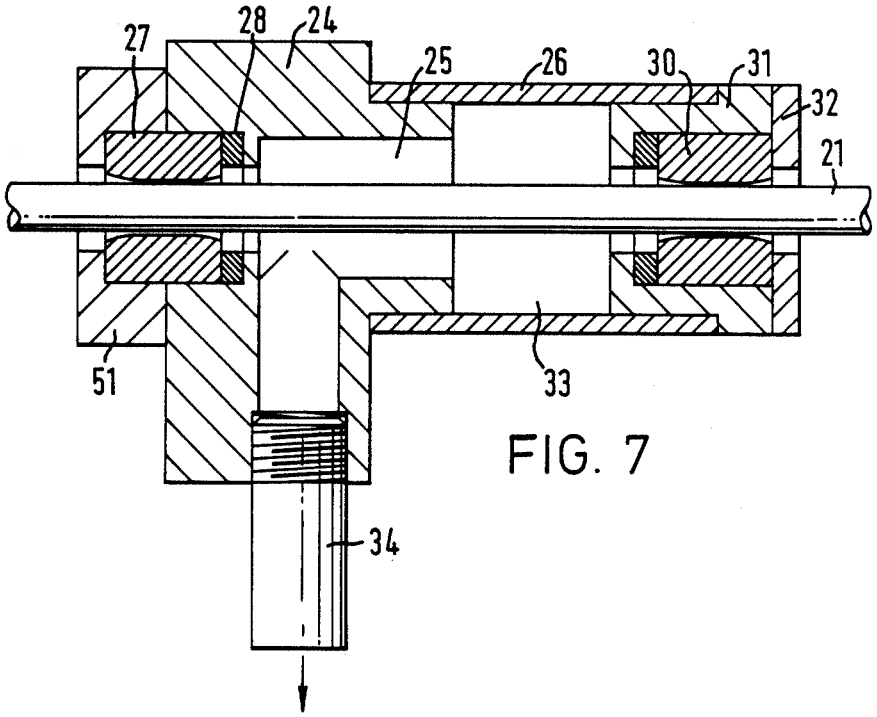
FIG. 7 is a longitudinal section through an apparatus according to the present invention used for drying a wet wire.

FIG. 7 shows a low pressure device which is substantially identical to the low pressure apparatus shown in FIGS. 1 to 3 and used for drying and/or cooling a wire 21. Its function is the same as that described with reference to FIGS. 1 to 3. In this device the guide 27 is fixed and held in place by a retainer 51.

Figure 8:
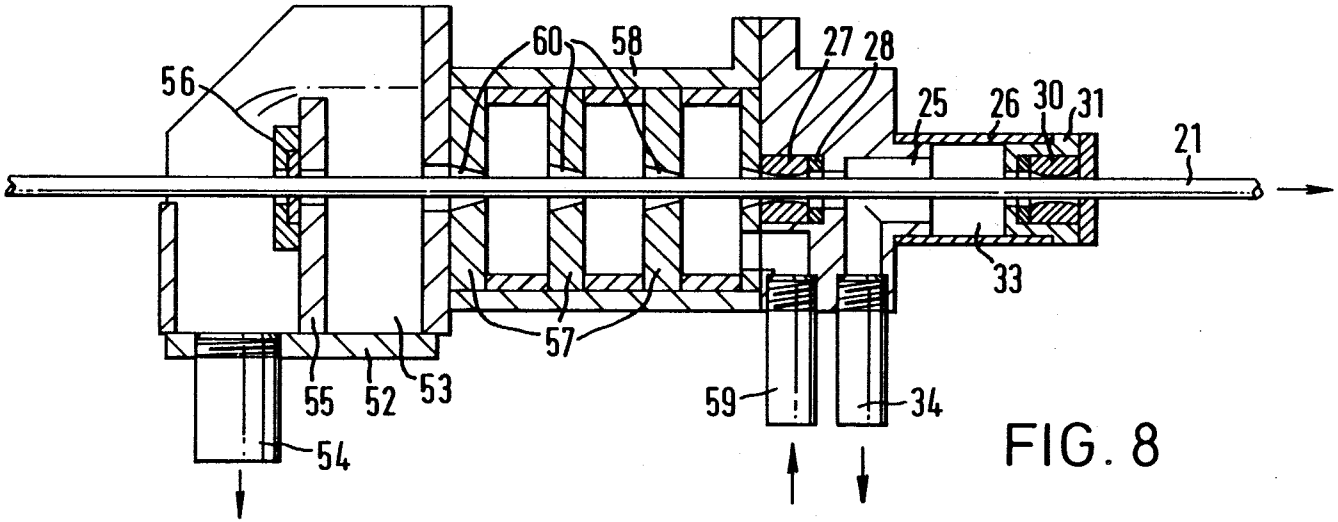
FIG. 8 is a longitudinal section through a wire cleaning device provided with apparatus according to the present invention.

FIG. 8 shows a wire cleaning device having at its upstream end a structure 52 having a chamber 53 separated from a drain conduit 54 by a wall 55 which forms a weir and which is provided with a wire guide 56. At its downstream end there is provided a low pressure apparatus which is substantially identical with that shown in FIG. 7. Located between the upstream structure 52 and the low pressure apparatus are a plurality of baffles 57 provided in a cylinder 58.

Water enters the cylinder 58 through an inlet conduit 59 and is forced through orifices 60 provided in the baffles 57 through which the wire 21 passes. The flow of water through the orifices 60 purges the wire 21 to clean it. The water flows into the chamber 53 and then overflows the weir forming wall 55 and flows through the drain conduit 54.

Figure 11:
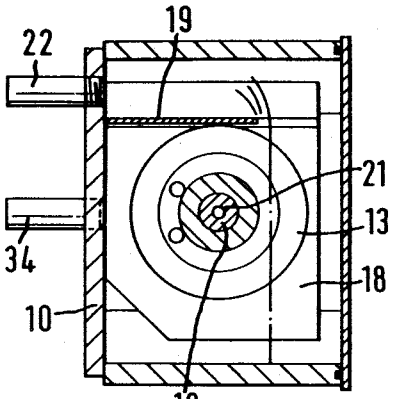
FIG. 11 is a transverse cross-section taken along the line 11—11 indicated on FIG. 10.
Figure 10:
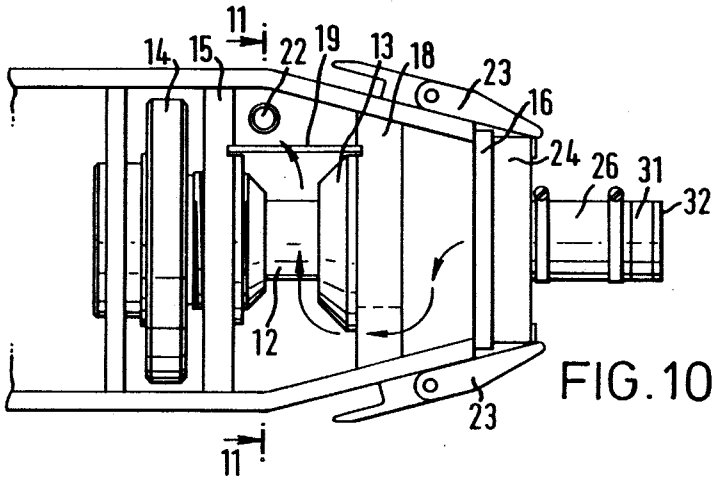
FIG. 10 is a plan view of the apparatus of FIG. 8.
Figure 9:
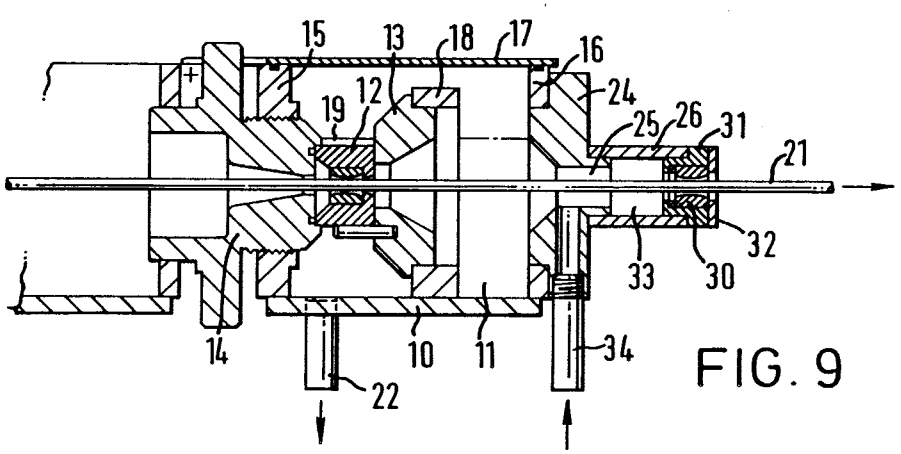
FIG. 9 is a longitudinal section of a wire drawing device constituting yet another embodiment of the invention.

The embodiment shown in FIGS. 9 to 11 is similar to that described in FIGS. 1 to 3 and like parts are denoted by reference numerals corresponding to those shown on FIGS. 1 to 3. In this embodiment the drain conduit 22 is connected to a vacuum source so that a sub-atmospheric pressure is produced in the chamber 11 above the level of the liquid coolant and the liquid coolant is supplied through the conduit 34 so that the chamber 33 also contains the liquid coolant. It will be appreciated that the bath of liquid coolant is at a sub-atmospheric pressure and therefore air will flow into the chamber 33 through the guide 30 at high velocity which will wire the wipe 21. The cover 17 in this embodiment is sealed to prevent air flow into the apparatus between the cover 17 and the structure forming the chamber 11. The guide 27, seal 28 and retainer 29 are dispensed within this embodiment.

Instead of initially cooling the wire by immersing it in a bath of liquid coolant with a weir as in some of the above described embodiments, it is possible to cool the wire by spraying or cascading liquid coolant onto the wire.

Figure 12:
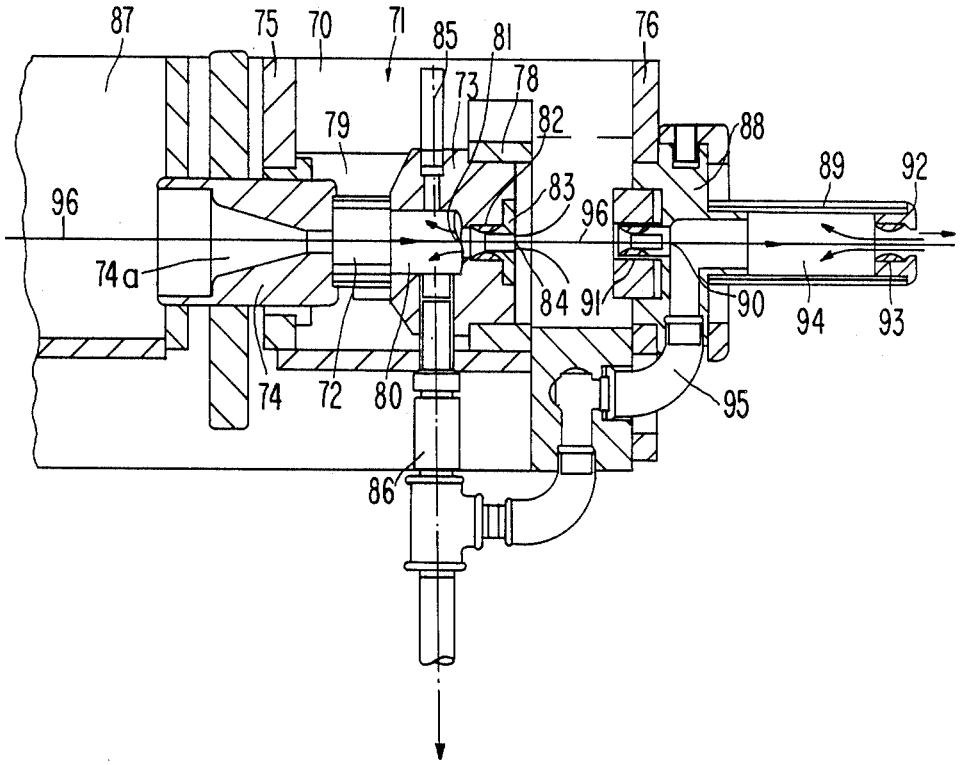
FIG. 12 is a longitudinal section through an apparatus of a further embodiment of the invention.

Referring to FIG. 12, the apparatus comprises a structure 70 defining a first chamber 71 in which is located a drawing die 72 which is clamped against a die support 73 by a clamping nut 74 which extends through an end wall 75 forming part of the structure 70. The nut 74 is provided with a bore **74*a* forming a guide for the wire passing through to the die 72. The structure 70 has an end wall 76 and the chamber 71 can be closed at its upper end by a loose cover (not shown) if desired. Located within the chamber 71 between the end walls 75 and 76 is an intermediate wall 78 in which the die support 73 is mounted. A liquid coolant, such as water, enters the chamber 71 on the downstream side of the wall 78 and can flow through or around the wall 78 to the part of the chamber 71 in which the die 72 is located and the liquid flows over a vertical plate 79 which extends between the end wall 75 and the intermediate wall 78 and which forms a weir. On the downstream side of the plate 79 there is provided an outlet (not shown) for the liquid. The level of the liquid in the chamber 71 upstream of the plate 79 is such as to submerge the drawing die 12**.

Formed within the die support 73 is a second chamber 80 which extends from the outlet of the die 72 and which at its rear end communicates with a passageway 81 in which is provided a guide 82 retained by a retainer plate 83 fixed to the support 73 and having an aperture 84. The die support 73 has secured to it an air inlet pipe 85 which communicates with the chamber 80 and the chamber 80 is connected by a conduit 86 to a means, such as a vacuum pump, for creating a sub-atmospheric pressure within the chamber 80.

Provided upstream of the structure 70 there is a compartment or container 87 in which a drawing lubricant is provided. Connected to the end wall 76 is a member 88 which supports a tube 89. The member 88 has a bore 90 which is closed at one end by a wire guide 91 and the other end of the tube 89 is closed by a member 92 provided with a wire guide 93.

The tube 89 forms a third chamber 84 which is connected by a conduit 95 to the conduit 86 so as to produce a sub-atmospheric pressure in the chamber 94.

The apparatus operates as follows:

The wire 96 passes through the compartment or container 87 where a drawing lubricant is applied to the wire 96. It then passes through the bore **74*a* of the nut 74 which guides it into the drawing die 72. After being drawn through the die 72 it passes through the chamber 80, through the passageway 81, guide 82 and aperture 94, through the liquid coolant in the chamber 71 and then through the guide 91, bore 90, chamber 94 and out of the apparatus through the guide 93**.

The liquid coolant flows into the chamber 71 and over the top of the wier plate 79 and then flows to a drainage conduit. The level of liquid within the chamber 71 on the upstream side of the plate 79 is sufficient to submerge the drawing die 72 and the portion of the wire 96 which extends from the guide 82 to the guide 91. Because the pressure within the chamber 80 is below atmospheric pressure, fresh supplies of liquid coolant are drawn in at high velocity over the surface of the wire 96 through the annular gap formed between the wire 96 and the guide 82 and this coolant is immediately drawn away by the vacuum and the outlet of the die 72 is not wetted. Because the cooling liquid is directed straight onto the surface of the wire 96, insulating pockets of steam cannot form on the wire 96 within the chamber 80 and due to this and the velocity of the liquid coolant a better transfer of heat is effected. The wire 96 is further cooled in passing through the liquid coolant in the chamber 71.

Some of the cooling liquid will pass through the bore of the wire guide 91 with the wire 96 and the wire 96 enters the chamber 94 in a wet condition. Because the pressure within the chamber 94 is below atmospheric pressure, the vaporization temperature of the liquid is lowered and the liquid on the wire is evaporated which further cools and dries the wire 96.

Advantage is taken within the chambers 80 and 94 of the latent heat of vaporization at the sub-atmospheric pressure. The sub-atmospheric pressure within the chamber 94 will cause air to flow into the chamber 94 through the guide 93 at high velocity which will wipe the wire 96 and sweeps any excess cooling fluid back into the chamber.

If the wire 96 breaks during the drawing operation, any liquid which enters the chamber 80 is immediately drawn away by the vacuum system and the die passage is not wetted and liquid cannot flow through the die 72 into the compartment 87 to contaminate the drawing lubricant contained therein.

Even though the described embodiments have referred specifically to the drawing, cooling and cleaning of wire, it will be appreciated that the invention can be used in connection with any elongate material, such as tube or strip material.

What is claimed is:

1. Apparatus for use in cooling, cleaning and/or drying elongate material, comprising a first chamber having an inlet and an outlet through which the elongate material may enter and leave said chamber along a predetermined path; a drawing die positioned within said first chamber along said predetermined path and having inlet and outlet sides; supply means for supplying a liquid coolant to create a reservoir within the said first chamber at least to submerge said drawing die and the elongate material; means within said first chamber for defining a second chamber at said outlet side of said drawing die for receiving the elongate material upon its emergence from said drawing die and prior to passage through the liquid coolant reservoir, said second chamber having an outlet side through which the elongate material emerges for passage into said liquid coolant reservoir of said first chamber; guide means at said outlet side of said second chamber for defining an opening which receives the elongate material with clearance to form an annular gap between said second chamber and said liquid coolant reservoir; and a third chamber at said outlet of said first chamber through which the elongate material passes upon emergence from the coolant in said reservoir, said second and third chambers being connectable to a source for creating a sub-atmospheric pressure in said second and third chambers whereby the sub-atmospheric pressure in said second chamber causes fresh supplies of liquid coolant to be drawn in at high upstream velocity along the surface of the elongate material to cool same, and sub-atmospheric pressure in said third chambers causes a rapid upstream flow of air along the surface of the elongate material to wipe same of liquid coolant to thereby cool and dry the elongate material.

2. Apparatus as defined in claim 1, wherein said second chamber is connected to and in fluid-flow communication with an air inlet pipe.

3. Apparatus as defined in claim 1, further comprising guide means for guiding the elongate material from said second chamber into said reservoir of said first chamber and for substantially sealing said second chamber from said reservoir and minimizing the flow of liquid coolant from said reservoir into said second chamber.

4. Apparatus as defined in claim 1, wherein said third chamber is comprises an elongate tubular member.

5. Apparatus as defined in claim 1, further comprising guide means for guiding the elongate material from said first chamber to said third chamber and for substantially sealing said third chamber from said reservoir and minimizing the flow of liquid coolant from said reservoir to said third chamber.

6. Apparatus as defined in claim 1, further comprising conduit means for connecting said both second and third chambers to a common source of sub-atmospheric pressure.

7. Apparatus as defined in claim 1, further comprising guide means at the outlet of said third chamber for guiding the elongate material out of said third chamber and having dimensions to permit a flow of air at high velocity over the surface of the elongate material when a sub-atmospheric pressure is established within said third chamber.

8. Apparatus as defined in claim 1, further comprising means at said inlet of said first chamber for application of lubricant to the elongate material prior to passage through said drawing die.

9. Apparatus for use in cooling, cleaning and/or drying elongate material, comprising a first chamber having an inlet and an outlet through which the elongate material may enter and leave said chamber along a predetermined path; a drawing die positioned within said first chamber along said predetermined path and having inlet and outlet sides; supply means for supplying a liquid coolant to create a reservoir within the said first chamber at least to submerge said drawing die and the elongate material; means within said first chamber for defining a second chamber at said outlet side of said drawing die for receiving the elongate material upon its emergence from said drawing die and prior to passage through the liquid coolant reservoir; a third chamber at said outlet of said first chamber through which the elongate material passes upon emergence from the coolant in said reservoir, said second and third chambers being connectable to a source for creating a sub-atmospheric pressure in said second and third chambers; and a plate or wall within said first chamber for forming a weir within said first chamber and defining the level of liquid coolant within said reservoir.

* * * * *